US005419299A

United States Patent [19]

Fukasawa et al.

[11] Patent Number: 5,419,299

[45] Date of Patent: May 30, 1995

[54] SELF-DIAGNOSIS APPARATUS AND METHOD FOR FUEL EVAPORATIVE EMISSION

[75] Inventors: Osamu Fukasawa, Obu; Hisashi Iida, Aichi, both of Japan

[73] Assignee: Nippondenso Co., Ltd., Kariya, Japan

[21] Appl. No.: 159,510

[22] Filed: Nov. 30, 1993

[30] Foreign Application Priority Data

Nov. 30, 1992 [JP] Japan ..... 4-320274

[51] Int. Cl.[6] ..... F02M 33/02

[52] U.S. Cl. ..... 123/520

[58] Field of Search ..... 123/516, 518, 519, 520, 123/198 D

[56] References Cited

U.S. PATENT DOCUMENTS

| | | | |
|---|---|---|---|
| 5,193,512 | 3/1992 | Steinbrenner et al. | 123/520 |
| 5,195,498 | 3/1993 | Siebler et al. | 123/520 |
| 5,205,263 | 4/1993 | Blumenstock | 123/520 |
| 5,245,973 | 9/1993 | Otsuka et al. | 123/520 |
| 5,261,379 | 11/1993 | Lipinski et al. | 123/520 |
| 5,263,462 | 11/1993 | Reddy | 123/520 |
| 5,265,577 | 11/1993 | Denz et al. | 123/520 |
| 5,275,144 | 1/1994 | Gross | 123/520 |
| 5,295,472 | 3/1994 | Otsuka et al. | 123/520 |
| 5,317,909 | 6/1994 | Yamada et al. | 123/520 |

FOREIGN PATENT DOCUMENTS

| | | |
|---|---|---|
| 63-85237 | 4/1988 | Japan . |
| 2102360 | 4/1990 | Japan . |
| 4308350 | 10/1992 | Japan . |
| 4318268 | 11/1992 | Japan . |

*Primary Examiner*—Henry C. Yuen
*Assistant Examiner*—Thomas N. Moulis
*Attorney, Agent, or Firm*—Cushman, Darby & Cushman

[57] ABSTRACT

A self-diagnosis apparatus and method for use in a fuel evaporative emission control system for a vehicle having an internal combustion engine. A space part of a fuel tank is coupled with an intake air passage via a vapor passage. Fuel vapors from the fuel tank pass through the vapor passage. A canister is provided in the vapor passage to absorb the fuel vapors from the fuel tank. The internal pressure of the space part of the fuel tank is detected by a pressure detecting unit. The quantity of change in the internal pressure during the lapse of a certain time period is calculated by a calculating unit. The internal pressure change quantity is compared with a predetermined reference value, and thus abnormality is judged by a judgement unit in accordance with the comparison result.

19 Claims, 9 Drawing Sheets

SELF-DIAGNOSIS APPARATUS AND METHOD FOR FUEL EVAPORATIVE EMISSION

BACKGROUND OF THE INVENTION

The present invention relates to a self-diagnosis apparatus which performs the self-diagnosis for a fuel evaporative emission control system without discharging the fuel vapors, which have been generated in a fuel tank, into the atmosphere, and a method employing the same. In particular, the present invention is designed in such a way as to be capable of being used as a self-diagnosis apparatus, for use in a fuel evaporative emission control system, in which the fuel vapors, which have been generated in a fuel tank of a vehicle, are absorbed in a canister and then the fuel vapors thus absorbed in the canister are introduced into an intake manifold to be burned in an engine, and a method employing the same.

One example of the so-called fuel evaporative emission control system in which in order to prevent the fuel vapors, which have been generated in a fuel tank, from being discharged into the atmosphere, the fuel vapors are absorbed in an activated charcoal filled in a canister and then the fuel vapors thus absorbed in the canister are introduced through an intake manifold into an internal combustion engine to be burned therein is disclosed in Japanese patent application un-examined publication No. JP-A-63-85237.

However, if the vapor leaks are present in a passage between the fuel tank and the canister when introducing the fuel vapors into the canister, a part of the fuel vapors will not be introduced into the canister but be discharged into the atmosphere.

Therefore, there is need for judging whether or not the abnormal state such as the vapor leak is present in the passage between the fuel tank and the canister in such a fuel evaporative emission control system. As for a technology for detecting the vapor leak, there is the technology disclosed in U.S. Pat. No. 5,193,512 issued to Steinbrenner et al. on Mar. 16, 1993.

In the invention disclosed in U.S. Pat. No. 5,193,512, the internal pressure in the fuel tank is compared with a predetermined reference pressure, and the abnormality in the device for processing fuel vapors is detected in accordance with the comparison result. Then, in the case where the abnormality in that device is detected, the alarm alerts an operator so that the operator is able to perform the suitable processing, so that the leakage of the fuel vapors is minimized.

However, in the judgement of the abnormality in the fuel evaporative emission control system disclosed in U.S. Pat. No. 5,193,512, the internal pressure in the fuel tank is first detected, and then on the basis of the detection result, it is judged whether or not the fuel vapor processing device is in an abnormal state. Therefore, there is need for correcting the dispersion in the characteristics such as the accuracy, the temperature characteristics and the secular change of the pressure sensor provided in the fuel tank for detecting the internal pressure in the fuel tank, thereby to perform the detection.

As examples of the technology for detecting the internal pressure in the fuel tank by the pressure sensor to detect the abnormality of the fuel evaporative emission control system, there are the technologies disclosed in, for example, JP-A-2-102360, JP-A-4-308350 and JP-A-4-318268 as Japanese Publications of Unexamined Patent Applications which were filed in the Japanese Patent Office.

SUMMARY OF THE INVENTION

It is therefore an object of the present invention to provide a self-diagnosis apparatus, for use in a fuel evaporative emission control system, which can avoid the erroneous detection of the abnormality due to the dispersion in the characteristics such as the accuracy and the temperature characteristics of a pressure sensor provided in a fuel tank for detecting the internal pressure in the fuel tank at the time when judging the abnormality such as the leak of fuel vapors, and a method employing the same.

It is another object of the present invention to provide a self-diagnosis apparatus, for use in a fuel evaporative emission control system, which can avoid the erroneous detection of the abnormality due to the dispersion in the characteristics such as the accuracy and the temperature characteristics of a pressure sensor provided in a fuel tank for detecting the internal pressure in the fuel tank, and in which the reliability of detection of the internal pressure in the fuel tank is improved, and a method employing the same.

A self-diagnosis apparatus, for use in a fuel evaporative emission control system, according to the present invention includes: a vapor passage which couples a space part in a fuel tank and an intake manifold of an internal combustion engine to each other and through which fuel vapors pass; a canister which is provided in the vapor passage and operates to absorb the fuel vapors from the fuel tank; a pressure detecting unit for detecting an internal pressure in the space part of the fuel tank; a unit for calculating the quantity of change in the internal pressure, detected by the pressure detecting unit, during the lapse of a certain period of time; and a judgement unit for comparing the quantity of change in the internal pressure and a predetermined reference value with each other to perform the judgement of abnormality on the basis of the comparison result.

In a method of performing a self-diagnosis for a fuel evaporative emission control system according to the present invention, the quantity of change in the internal pressure in the fuel tank which has been detected during the lapse of a certain period of time is detected. Then, the quantity of change in the internal pressure and the predetermined reference value are compared with each other, and then in accordance with the comparison result, the judgement of the abnormality is performed.

DESCRIPTION OF THE PREFERRED EMBODIMENTS

The preferred embodiments of the present invention will hereinafter be described in detail with reference to the accompanying drawings.

Figure 1:
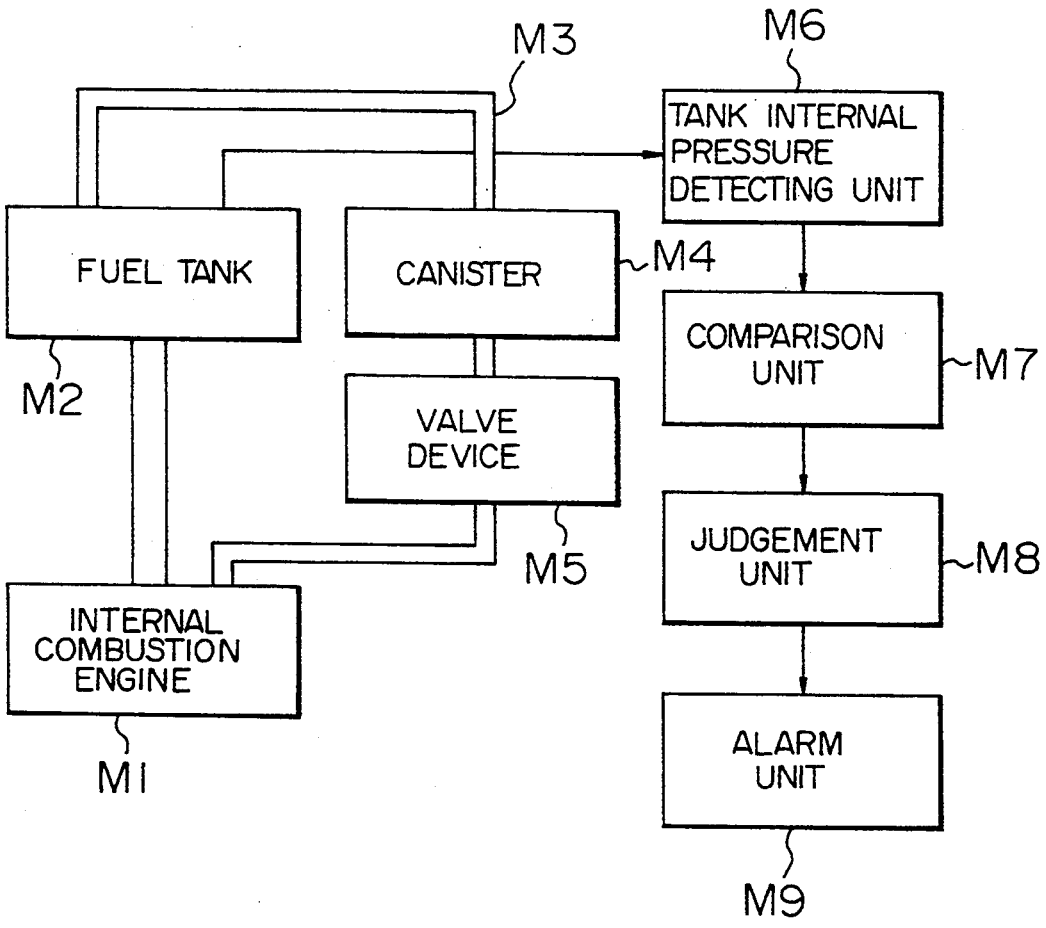
FIG. 1 is a schematic block diagram showing conceptually a configuration of a self-diagnosis apparatus, for use in a fuel evaporative emission control system, according to a first embodiment of the present invention.

FIG. 1 shows a block diagram of a self-diagnosis apparatus, for use in a fuel evaporative emission control system, according to an embodiment of the present invention. The self-diagnosis apparatus of the embodiment shown in FIG. 1 includes, but is not limited to,: a vapor passage M3 which operates to introduce the fuel vapors from a fuel tank M2, which stores the fuel to be supplied to an internal combustion engine M1 therein, to the air intake side of the internal combustion engine M1; a canister M4 which is provided in the midway of the vapor passage M3 and operates to absorb the fuel vapors which have been generated in the fuel tank M2; a valve device M5 which is provided in the midway of the vapor passage M3 and operates to open and close the vapor passage M3; a tank internal pressure detecting unit M6 which operates to detect an internal pressure in the fuel tank M2; a comparison unit M7 which operates to compares the width (range) of the change in the internal pressure in the fuel tank which are obtained from a difference between a maximum value and a minimum value of the internal pressure in the fuel tank, which have been detected at the different time points by the tank internal pressure detecting unit M6 and a threshold pressure width (range) with each other; a judgement unit M8 which operates to judge, at the time when the width of the change in the internal pressure in the fuel tank has been judged to be smaller than the threshold pressure width by the comparison unit M7, that the closed system on the side of the fuel tank M2 is in an abnormal state; and an alarm unit M9 which operates to generate, at the time when the abnormality in the closed system has been judged by the judgement unit M8, an alarm to an operator.

Figure 6:
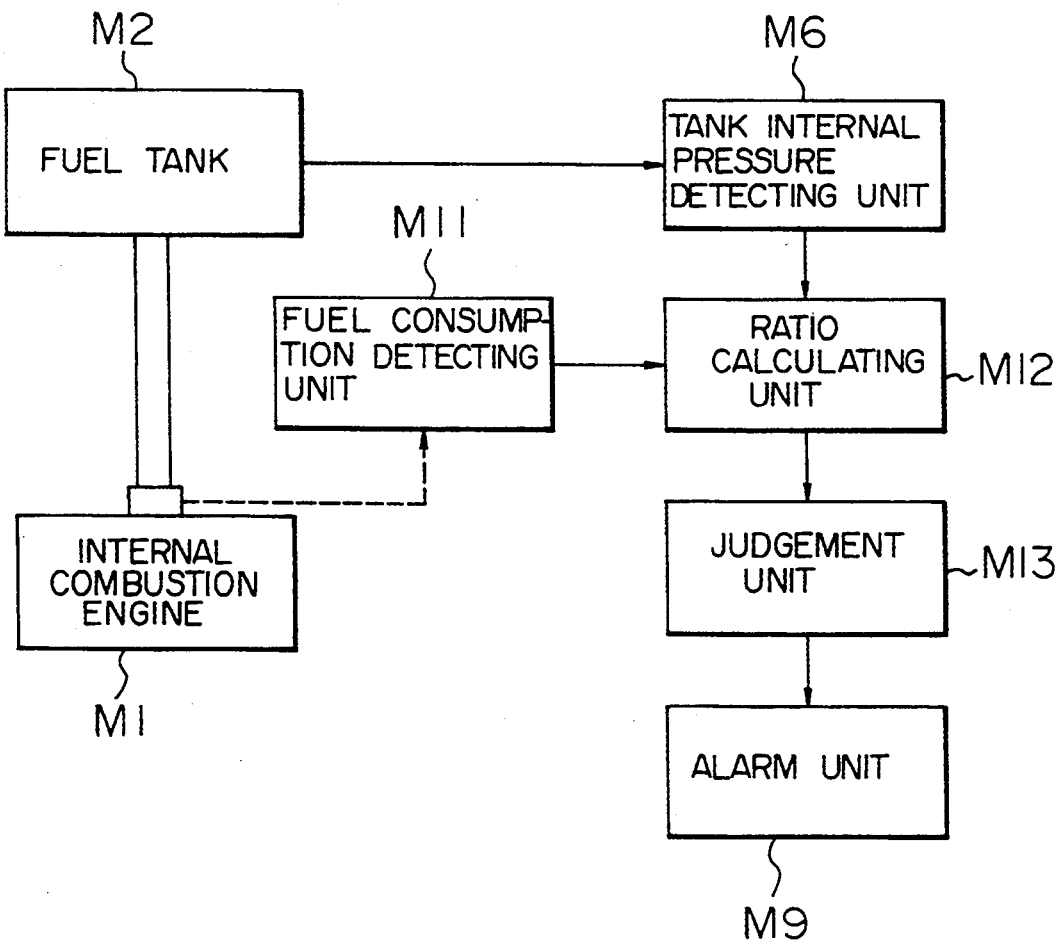
FIG. 6 is a block diagram showing conceptually a configuration of a self-diagnosis apparatus, for use in a fuel evaporative emission control system, according to a second embodiment of the present invention.

Another embodiment of the self-diagnosis apparatus, for use in the fuel evaporative emission control system, according to the present invention includes, as shown in the form of a block diagram of FIG. 6, but is not limited to,: the fuel tank M2 which stores the fuel to be supplied to the internal combustion engine M1; a tank internal pressure detecting unit M6 which operates to detect the internal pressure in the fuel tank M2; a fuel consumption detecting unit M11 which operates to detect a value corresponding to the quantity of the consumed fuel supplied from the fuel tank M2 to the internal combustion engine M1; a ratio calculating unit M12 which operates to calculate the ratio of an up rate and a down rate of the quantity of change in the internal pressure in the fuel tank during the lapse of a predetermined period of time in accordance with the value corresponding to the fuel consumption which has been detected by the fuel consumption detecting unit M11; a judgement unit M13 which operates to judge, at the time when the ratio of the up rate and the down rate of the quantity of internal pressure in the fuel tank, which was calculated by the ratio calculating unit M12, has been judged to be smaller than a predetermined threshold pressure ratio, that something is wrong with the passage extending from the fuel tank M2 to the internal combustion engine M1; and an alarm unit M9 which operates to generate, at the time when the abnormality has been judged by the judgement unit M13, an alarm to the operator.

The self-diagnosis apparatus and the method, for use in the fuel evaporative emission control system, of the embodiments of the present invention will hereinafter be described in more detail.

First Embodiment

Figure 2:
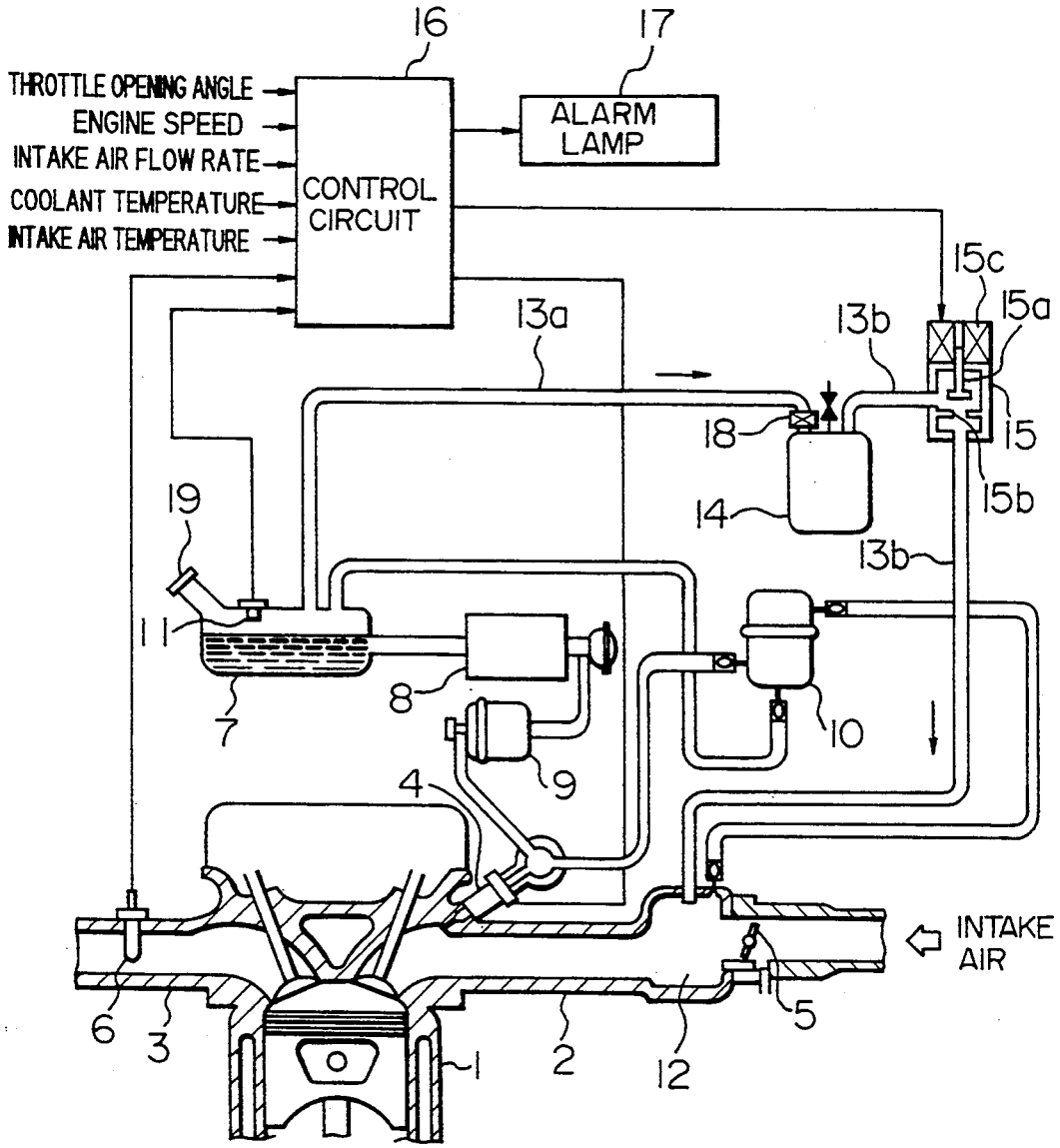
FIG. 2 is a diagram showing a structure of an internal combustion engine provided with the fuel evaporative emission control system to which the self-diagnosis apparatus of the first embodiment of the present invention is applied, and the periphery thereof.

FIG. 2 is a diagram showing a structure of an engine provided with the fuel evaporative emission control system to which the self-diagnosis apparatus of the first embodiment of the present invention is applied, and the periphery thereof.

In FIG. 2, a multiple cylinder (or single cylinder) engine 1 is mounted as an internal combustion engine on a vehicle, and an intake manifold 2 (an intake passage) and an exhaust manifold 3 are connected to the engine 1. An electromagnetic fuel injector 4 is provided in each cylinder intake port of the intake manifold 2. In addition, the intake manifold 2 is provided with a throttle valve 5. An oxygen sensor (hereinafter, referred to as "the $O_2$ sensor", when applicable) 6 for detecting the air-fuel ratio is provided in the exhaust manifold 3. Incidentally, a pressure sensor 11 for detecting the internal pressure in a fuel tank 7 is provided on a ceiling panel of the fuel tank 7.

The fuel supplying system for supplying and controlling the fuel to the fuel injectors 4 is constructed as follows.

First, the fuel stored in the fuel tank 7 is supplied through a fuel filter 9 to each fuel injector 4 by a fuel pump 8, and at the same time, the fuel pressure is adjusted to a predetermined value. The upper space in the fuel tank 7 is communicated with a surge tank 12 of the intake system through purge pipes 13*a* and 13*b* as the purge system. A canister 14 which is filled with the activated charcoal as the absorption substance and an electromagnetic valve for the purge (hereinafter, referred to as "the purge valve" for short, when applicable) 15 are disposed between the purge pipes 13*a* and 13*b*. That is, a passage extending from the fuel tank 7 to the canister 14 is a closed system. In the purge system, the surge tank 12 side of the passage with respect to the canister 14 constitutes the purge passage 13*b*, and a purge valve 15 is provided in the midway position of the purge passage 13*b*. This purge valve 15 is normally actuated (as shown in FIG. 2) in the direction, in which a valve element 15*a* opens a sheet member 15*b*, by a spring (not shown). However, the valve element 15*a* closes the sheet part 15*b* by magnetizing a coil 15*c*. Therefore, the purge passage 13*b* is opened by demagnetizing the purge valve 15 and the purge passage 13*b* is closed by magnetizing the purge valve 15. In addition, the fuel vapors from the fuel tank 7 are absorbed in the activated charcoal filled in the canister 14. A pressure regulator 10 operates to maintain the fuel pressure in each fuel injector 4 at a predetermined value.

A control circuit 16 which contains a microcomputer therein receives as its input a throttle opening angle signal sent from a throttle sensor for detecting the opening angle of the throttle valve 5, an engine speed signal sent from an engine speed sensor for detecting the engine speed of the engine 1, an intake air flow rate signal sent from an intake air flow sensor for detecting the intake air flow, a coolant temperature signal sent from a coolant temperature sensor for detecting the temperature of the engine coolant, and an intake air temperature signal sent from an intake air temperature sensor for detecting the temperature of the intake air. Then, on the basis of those signals, the control circuit 16 stores the data relating to the opening angle of the throttle valve 5, the engine speed, the air flow rate, the temperature of the engine coolant, and the temperature of the intake air. In addition, the control circuit 16 receives a signal sent from the $O_2$ sensor 6 as its input.

For the throttle sensor, the engine speed sensor, the air flow sensor, the coolant temperature sensor, and the intake air temperature sensor, the known sensors which are applicable to the engine and the vehicle are available. For the method as well in which on the basis of the signals sent from those sensors, the fuel injection time and other engine controlling quantities are determined by the control circuit 16, the known technology for controlling the engine is available.

Thus, the control circuit 16 obtains the basic injection time on the basis of both the engine speed and the inhaled air quantity, corrects the basic injection time by using the feedback correction coefficient and the like to obtain the next injection time, and makes the fuel injector 4 perform the fuel injection in the predetermined timing. In addition, the control circuit 16 receives a signal sent from the pressure sensor 11 as its input. Further, the control circuit 16 is connected to the purge valve 15 so that it controls the opening and closing of the purge valve 15. An alarm lamp 17 is disposed as the alarm device on an instrument panel of the vehicle and is controlled by an output of the control circuit 16.

In addition, the passage of the purge pipe 13*a* is closed by a valve 18 which operates to open and close the passage constituted by the purge pipe 13*a* between the fuel tank 7 and the canister 14, until the internal pressure in the fuel tank reaches a predetermined value. Then, at the time when that internal pressure exceeds the predetermined value, the valve 18 is opened so that the fuel vapors are introduced into the canister 14. In this connection, the valve 18 may be either an electromagnetic valve which is driven by the signal sent from the control circuit 16, or a mechanical check valve which is opened and closed depending on the pressure.

Next, the description will hereinbelow be given with respect to the operation of the control circuit 16 in the self-diagnosis apparatus, for use in the fuel evaporative emission control system, according to the first embodiment thus constructed.

Figure 3:
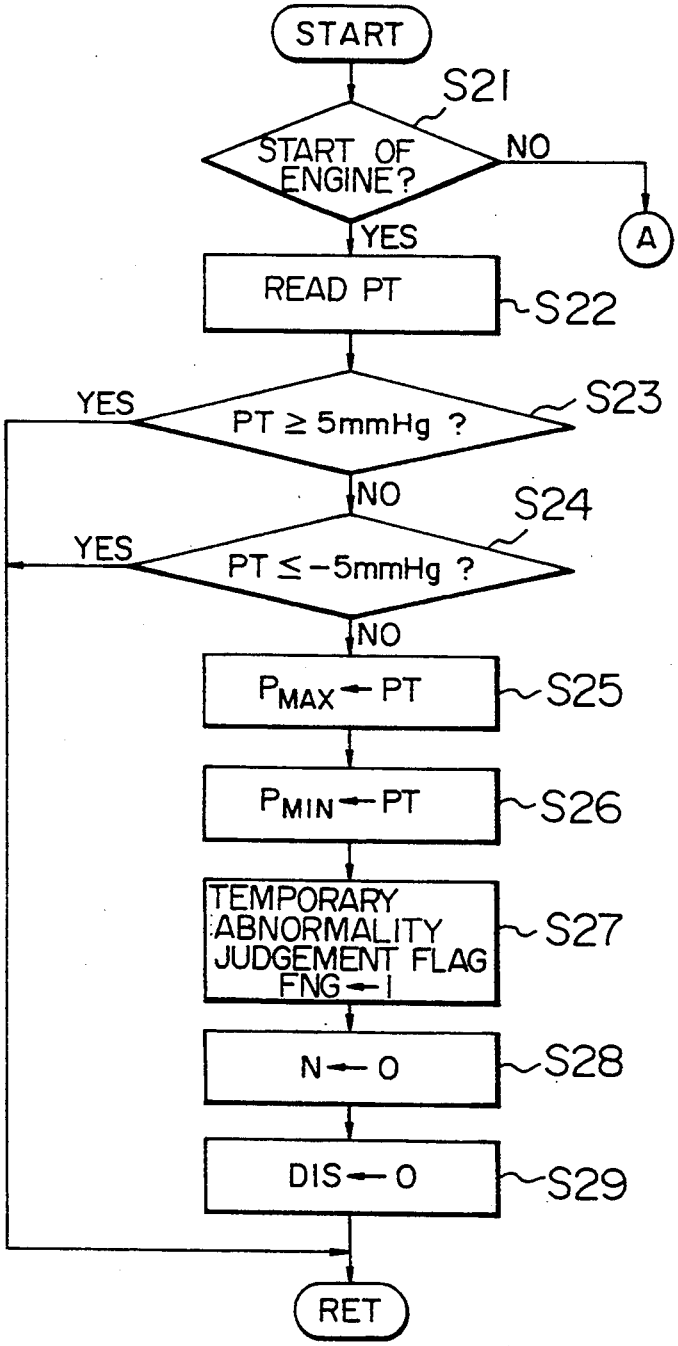
FIG. 3. is a flow chart, at the time of start of the engine, for controlling the self-diagnosis apparatus, for use in the fuel evaporative emission control system, as the first embodiment of the present invention.
Figure 4:
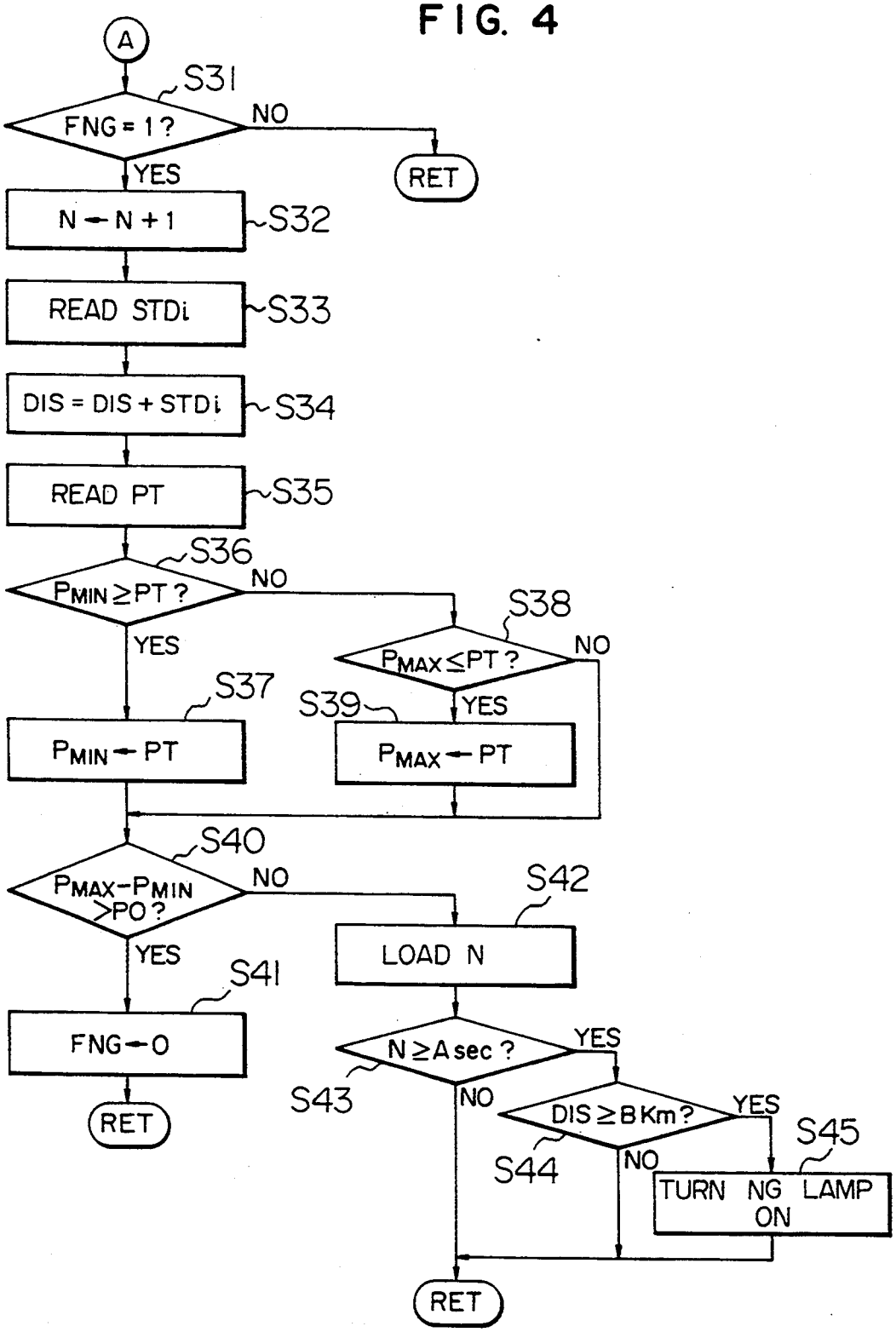
FIG. 4 is a flow chart, after start of the engine, for controlling the self-diagnosis apparatus, for use in the fuel evaporative emission control system, as the first embodiment of the present invention.

FIG. 3 is a flow chart with respect to the internal pressure in the fuel tank, at the time of start of the engine, useful in explaining the operation of the self-diagnosis apparatus, for use in the fuel evaporative emission control system, as the first embodiment of the present invention. FIG. 4 is a flow chart, after start of the engine, useful in explaining the operation of the self-diagnosis apparatus, for use in the fuel evaporative emission control system, as the first embodiment of the present invention. Moreover, FIGS. 5(*a*)–5(*c*) are diagrams showing one example of the change in the internal pressure in the fuel tank during the running of the vehicle.

The processing of the flow chart with respect to the internal pressure in the fuel tank, at the time of start of the engine, shown in FIG. 3, and the processing of the flow chart, after start of the engine, shown in FIG. 4 are executed at every interval of one second while executing the main routine for the engine control which is started by turning an ignition switch (not shown) on. The main routine for the engine control may include the routine for control of the fuel flow rate and the control of the ignition timing.

First, in Step S21, it is judged whether or not the engine 1 has just been started. In this connection, the start judgement is performed on the basis of the fact that the time when the engine speed reaches a predetermined engine speed, e.g., 500 rpm after turning the ignition switch on is a time point of start of the engine. It is, of course, to be understood that the start of the engine may also be judged by other methods. If the operation is at the time of just after start of the engine 1, the processing proceeds to Step S22. Then, in Step S22, the internal pressure PT in the fuel tank is detected by the pressure sensor 11. Then, if the internal pressure PT in the fuel tank is judged in Step S23 to be equal to be equal to or higher than 5 mmHg, or the internal pressure PT in the fuel tank is judged in Step S24 to be equal to or lower than −5 mmHg, it is judged that the fuel evaporative emission control system operates normally. In the case of the normal state, the purge valve 15 and the valve 18 are controlled to be opened so that the fuel vapors which have been generated in the fuel tank are absorbed in the activated charcoal filled in the canister 14, and then the fuel vapors thus absorbed in the canister 14 are introduced into the intake manifold 2 to be burned in the engine. For example, if the vapor leak is present in the passage between the fuel tank 7 and the canister 14, just after start of the engine 1, the change in the internal pressure in the fuel tank 7 will be decreased. For instance, in the case where just after start of the engine 1, the internal pressure PT in the fuel tank 7 is in the range of $-5\ \text{mmHg} < PT < 5\ \text{mmHg}$, there may be the possibility that the vapor leak is present in the passage between the fuel tank 7 and the canister 14. Then, a maximum value of the internal pressure PT which has been detected by the pressure sensor is stored in a memory PMAX in Step S25, and then, in Step S26, a minimum value thereof is stored in a memory PMIN. Then, the processing proceeds to Step S27. In Step S27, a temporary abnormality judgement flag FNG is on (FNG=1). Thereafter, in Step S28 and Step S29, a counter N and a travel distance storage memory DIS which is used for accumulation of the travel distance are respectively initialized. Then, the processing gets out of the routine from Step S21 to Step S29.

In the case where in Step S21, it is judged by the start judgement that the operation is not at the time of just after start of the engine 1. Then, the processing proceeds to Step S31. In Step S31, it is judged whether or not the temporary abnormality judgement flag FNG is on. If the temporary abnormality judgement flag FNG is not on, the processing gets out of this routine. Naturally, this is also applied to the specific case where the temporary abnormality judgement flag FNG is off in the middle of the processing (FNG=0).

In Step S31, it is judged whether or not the temporary abnormality judgement flag FNG is on. At this time, if the temporary abnormality judgement flag FNG is on, the processing proceeds to Step S32. In Step S32, the counter N is incremented by +1. At this time, since in the present embodiment, the calculation period required for the processing to enter this routine is set to one second, the count value of the counter N can be directly regarded as the elapsed period of time after start of the engine 1. Then, in Step S33 and Step S34, the current vehicle speed STDi (km/sec) is detected and then is converted into the travel distance to be stored in the travel distance storage memory DIS. In Step S35, the internal pressure PT in the fuel tank is detected. Then, in Step S36 to Step S39, the internal pressure PT in the fuel tank thus detected is compared with the maximum value stored in the memory PMAX and the minimum value stored in the memory PMIN. At this time, if necessary, in Step S37 or Step S39, the maximum value stored in the memory PMAX or the minimum value stored in the memory PMIN are updated to a larger value or smaller value, respectively.

Figure 5A:
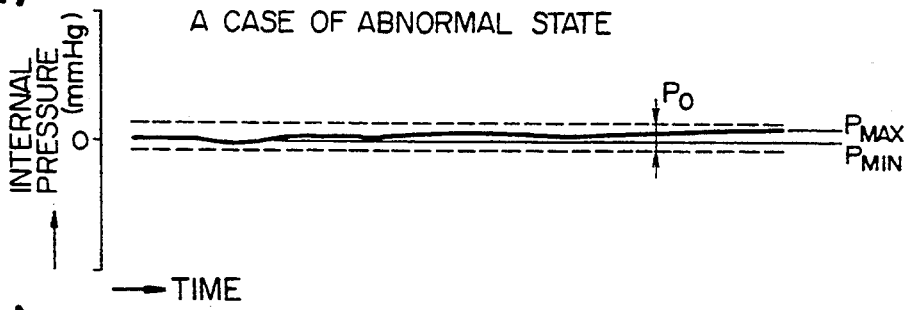
FIGS. 5(*a*)–5(*c*) are diagrams showing one example of the change in an internal pressure in a fuel tank during the travel of a vehicle.
Figure 5B:
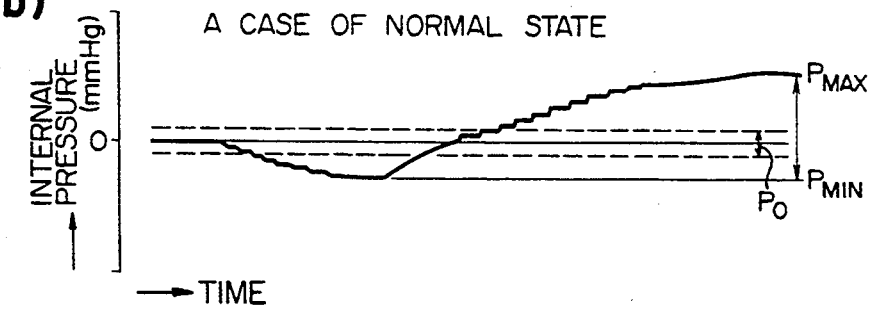
Figure 5C:
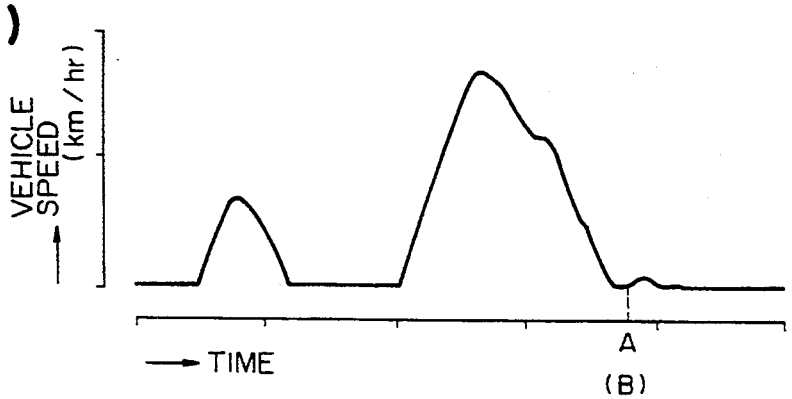

Thereafter, the processing proceeds to Step S40. In Step S40, the pressure difference between the maximum value in the memory $P_{MAX}$ and the minimum value in the memory $P_{MIN}$($P_{MAX}-P_{MIN}$) is compared with a predetermined pressure difference Po which is previously set as a threshold. Then, in the case where the pressure difference ($P_{MAX}-P_{MIN}$) is equal to or larger than the predetermined pressure difference Po, it is meant that no leak is present in the passage between the fuel tank 7 and the canister 14. Therefore, it is judged that the fuel evaporative emission control system operates normally. Then, the processing proceeds to Step S41. In Step S41, the temporary abnormality judgement flag FNG is off. However, in Step S40, in the case where the pressure difference ($P_{MAX}-P_{MIN}$) is smaller than the predetermined pressure difference Po, there may be the possibility that the the fuel evaporative emission control system does not operate normally. Therefore, the processing proceeds to Step S42. Then, the data relating to the elapsed period of time is read out from the counter N. Then, in Step S43, the elapsed period of time N the data of which has been stored in Step S42 and a predetermined elapsed period of time A (sec) as a threshold are compared with each other. If the elapsed period of time N is smaller than the predetermined elapsed period of time A (sec) as the threshold, the processing gets out of this routine directly. On the other hand, in the case where the elapsed period of time N is equal to or larger than the predetermined period of time A (sec), if in Step S44, a travel distance DIS does not reach a value equal to or larger than a predetermined travel distance B (km) as a threshold, the processing then gets out of this routine. If after start of the engine 1, the vehicle travels a distance equal to or longer than the predetermined travel distance B (km) as the threshold, or the elapsed period of time N is equal to or more than the predetermined period of time A (sec) as the threshold, for this period of time, the fuel consumption by the driving of the engine 1 is changed in accordance with the change in the vehicle speed as shown in FIG. 5(*c*). Thus, normally, the change in the internal pressure of the fuel tank 7 as shown in FIG. 5(*b*) is obtained along with the change in the fuel consumption. The above-mentioned thresholds A, B and Po are set on the basis of the pressure change in the normal operation state. Therefore, in the case where the elapsed period of time N is equal to or more .than the predetermined period of time A (sec) as the threshold and the travel distance DIS is equal to or longer than the predetermined travel distance B (km) as the threshold, when the width of the change in the internal pressure in the fuel tank 7 is, as shown in FIG. 5(*a*), smaller than the predetermined pressure difference Po, it is then judged that the fuel evaporative emission control system is in an abnormal state. Then, in Step S45, the alarm (NG) lamp 17 is turned on and off continuously or repeatedly, so that the operator is informed of occurrence of the vapor leak or the like in the closed system between the fuel tank 7 and the canister 14, i.e., the abnormality of the closed system on the side of the fuel tank 7 in the fuel evaporative emission control system.

Incidentally, the predetermined pressure difference Po as the threshold in Step S40 depends largely on the accuracy of the pressure sensor 11 provided in the fuel tank 7. For example, if the accuracy of the pressure sensor 11 is highly precise, the value of the predetermined pressure difference Po can be set to a small value.

In addition, in the flow chart of FIG. 3, in the case where in Step S23 and Step S24 just after start of the engine 1, the internal pressure PT in the fuel tank fulfills the relationship of $PT \geqq 5$ mmHg or $PT \leqq -5$ mmHg, respectively, the temporary abnormality judgement is not performed. This reason is as follows. That is, in the case where the elapsed time from the stopping of the operation of the engine to the restarting of the engine is short, the large quantity of fuel vapors are present in the space part in the fuel tank with the fuel temperature in the fuel tank kept at a high level. In this case, if no vapor leak occurs in the closed system, the internal pressure in the fuel tank is increased. Therefore, if the relationship of $PT \geqq 5$ mmHg is fulfilled, it can be judged that no vapor leak occurs in the closed system. Further, in the case where the elapsed time from the stopping of the operation of the engine to the restarting of the engine is long, since the fuel temperature in the fuel tank is stable at a room temperature, the quantity of fuel vapors in the space part of the fuel tank is relatively little. In this case, if no vapor leak occurs in the closed system, the internal pressure in the fuel tank is reduced due to the negative pressure of the intake manifold which is caused by the cranking of the engine. Therefore, if the relationship of $PT \leqq -5$ mmHg is fulfilled, it can be judged that no vapor leak occurs in the closed system between the fuel tank and the canister. It is, of course, to be understood that in the present invention, the values used as the criteria are not limited to those in the present embodiment. The judgement that the fuel evaporative emission control system operates abnormally is rapidly performed on the basis of the change in the internal pressure in the fuel tank up to that time.

In addition, even if in Step S27, the temporary abnormality judgement flag FNG is on, when in Step S40, the width of the change in the internal pressure in the fuel tank becomes larger than the predetermined pressure difference Po, it is judged that the fuel evaporative emission control system operates normally. For example, in the present embodiment, as shown in an example of the normal operation state of FIG. 5(*b*), in the acceleration just after start of the engine, the internal pressure in the fuel tank becomes the negative pressure, and in the second acceleration, that internal pressure is changed to the positive pressure. As a result, the width ($P_{MAX}-P_{MIN}$) of the change in the internal pressure in the fuel tank becomes larger than the predetermined pressure difference Po so that it is judged that the fuel evaporative emission control system operates normally.

However, even in the case where the travel distance DIS is equal to or longer than the predetermined travel distance B (km) as the threshold and also the elapsed period of time N is equal to or more than the predetermined period of time A (sec) as the threshold, if the change in the internal pressure in the fuel tank do not become larger than the predetermined pressure difference Po, it is meant that the vapor leak or the like occurs in the closed system between the fuel tank 7 and the canister 14. As a result, it is necessarily judged that something is wrong with the closed system on the side of the fuel tank 7. For example, in the present embodiment, as shown in an example of the abnormal operation state of FIG. 5(*a*), the abnormal operation state is continued in which even in the acceleration state after start of the engine, the internal pressure in the fuel tank is not changed, and thus, the width ($P_{MAX}-P_{MIN}$) of the change in the internal pressure in the fuel tank is equal to or smaller than the predetermined change difference Po. As a result, it is necessarily judged that something is wrong with the fuel evaporative emission control system.

In the above-mentioned embodiment shown in the form of the block diagram of FIG. 1, the comparison unit M7 executes the routine of Step S36 to Step S40 of the flow chart in FIG. 4. The judgement unit M8 executes the routine of Step S42 to Step S44. The alarm unit M9 executes Step S45. The functions of those units M7 to M9 are executed by the microcomputer contained in the control circuit 16 in accordance with the program to which the flow charts shown in FIGS. 3 and 4 are written.

In the present embodiment, since the abnormality judgement for the fuel evaporative emission control system is performed on the basis of the width of the change in the internal pressure in the fuel tank 7, the judgement is not influenced by the temperature dependency and the secular change of the input/output characteristics of the pressure sensor 11. In addition, it is possible to prevent the erroneous detection due to the dispersion in the characteristics of the pressure sensor. Therefore, in the embodiment of the present invention, both the accuracy and the reliability of the abnormality judgement for the fuel evaporative emission control system can be improved. The abnormality detection includes the detection of the malsealing and the imperfect mounting of a cap 19 at the filler opening of the fuel tank 7 as well as the detection of occurrence of the vapor leak in the fuel vapor piping.

Now, when embodying the present invention, the closing device M5 including the canister M4 (14) and the purge valve 15, which are provided in the middle of the Supply passage M3 (13*a*, 13*b*), may also be a leak valve in which the closing device M5 is mounted to the canister M4.

In addition, although the tank internal pressure detecting unit M6 for detecting the internal pressure in the fuel tank M2 (7) of the present embodiment is composed of one pressure sensor 11, when embodying the present invention, the unit M6 may also be composed of a plurality of pressure sensors.

Further, on the assumption that if in the routine from Step S42 to Step S44, after start of the engine 1, the travel distance DIS is equal to or longer than the predetermined travel distance B (km) and the elapsed period of time N is equal to or more than the predetermined period of time A (sec), the internal pressure in the fuel tank 7 which stores the fuel to be supplied to the engine 1 has obtained both the minimum value and the maximum value, the judgement unit M8 of the present embodiment sets both the travel distance and the elapsed period of time of the vehicle. However, when embodying the present invention, only one of the travel distance and the elapsed period of time may be set in such a case.

Further, the alarm unit M9, which operates to generate the alarm when the system has been judged to be in the abnormal state by the judgement unit M8 of the present embodiment, is composed of the alarm (NG) lamp 17. However, when embodying the present invention, the unit M9 may be composed of a unit for generating the audible sound, a unit for emitting the visible rays, or a unit which is constructed by the combination thereof.

Second Embodiment

In the present embodiment, as the canister 14 shown in the first embodiment, a canister is employed such that a relief valve 71 for controlling and adjusting the internal pressure in the fuel tank 7 within a predetermined value is provided.

Figure 7:
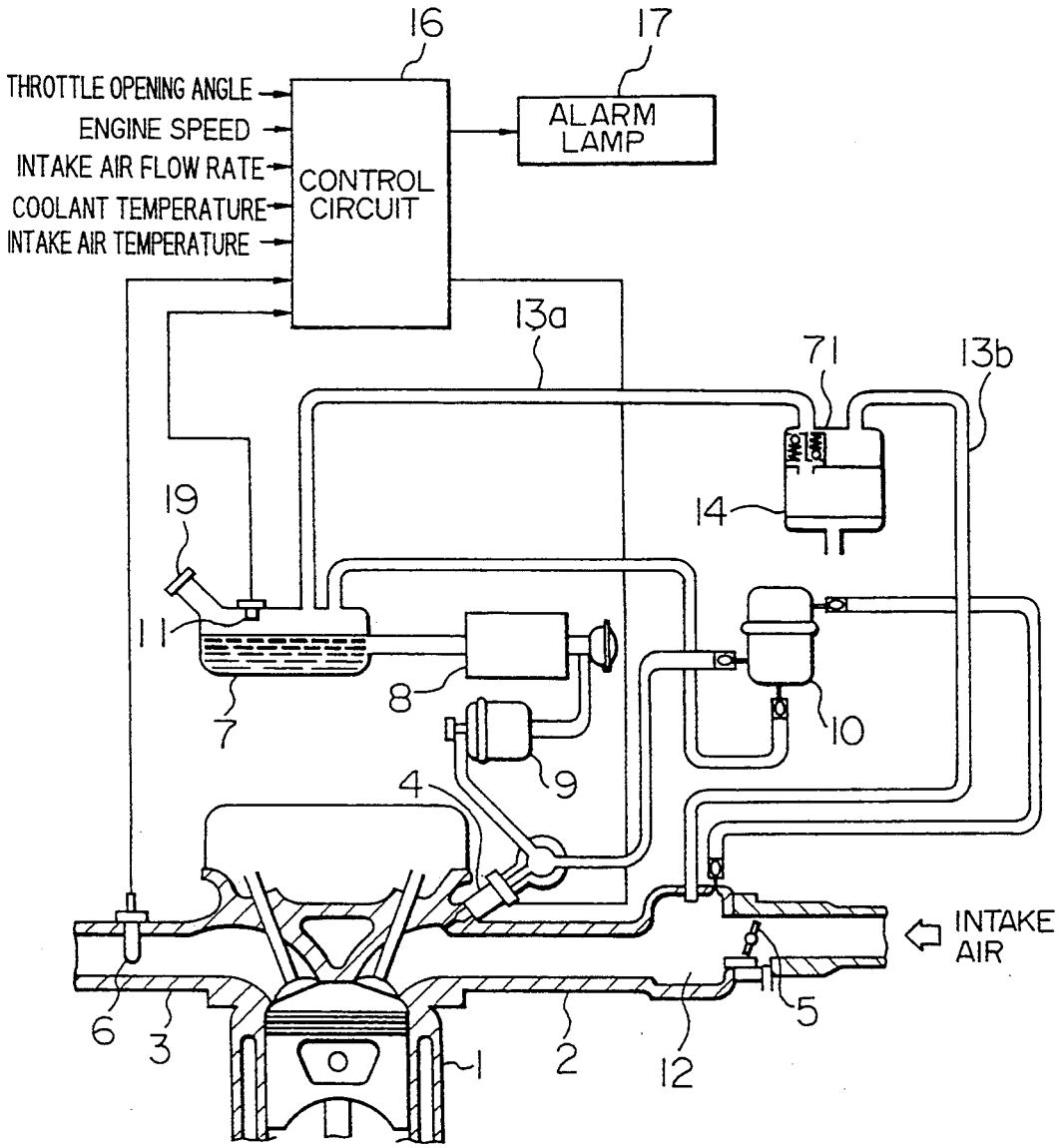
FIG. 7 is a diagram showing a structure of an internal combustion engine provided with the fuel evaporative emission control system to which the self-diagnosis apparatus of the second embodiment of the present invention is applied, and the periphery thereof.
Figure 8:
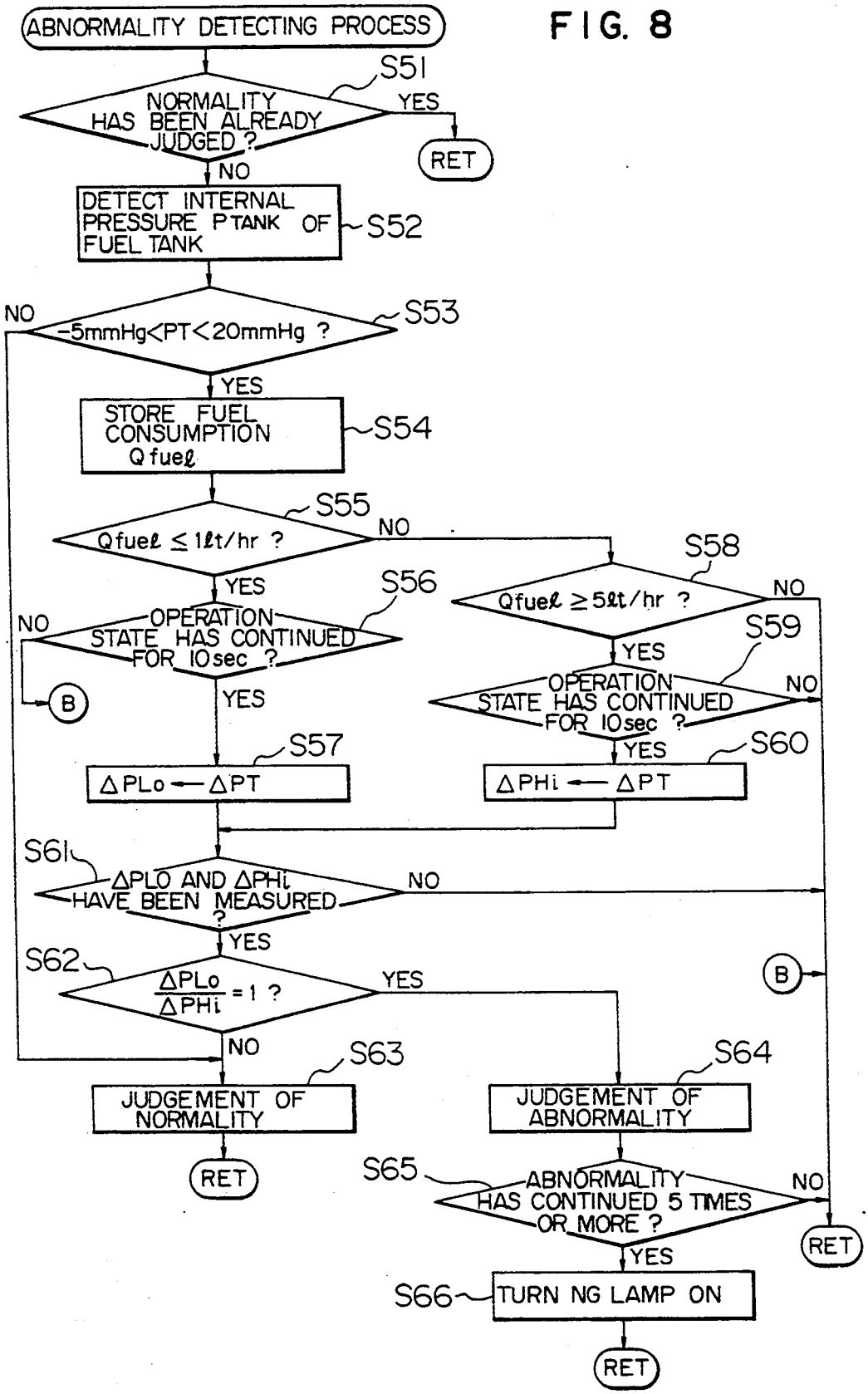
FIG. 8 is a flow chart of the abnormality detecting processing for controlling the self-diagnosis apparatus, for use in the fuel evaporative emission control system, as the second embodiment of the present invention.

FIG. 6 is a block diagram showing conceptually a configuration of the self-diagnosis apparatus, for use in the fuel evaporative emission control system, according to a second embodiment of the present invention. Moreover, FIG. 7 is a diagram showing a structure of the internal combustion engine provided with the fuel evaporative emission control system to which the self-diagnosis apparatus of the second embodiment of the present invention is applied, and the periphery thereof. FIG. 8 is a flow chart of the abnormality detection processing for controlling the self-diagnosis apparatus, for use in the fuel evaporative emission control system, as the second embodiment of the present invention. Moreover, FIGS. 9(*a*)–9(*c*) show an example of the demeanor of the fuel consumption and the internal pressure in the fuel tank during the running of the vehicle. Incidentally, in those figures, since the same reference numerals and symbols as those in the first embodiment represent the same or corresponding constituent parts as or to those in the first embodiment, the repeated description will hereinbelow be omitted for the sake of simplicity.

In the canister 14 of the present embodiment, in order to control and adjust the internal pressure in the fuel tank 7 within the predetermined value, the bidirectional relief valve 71 which is actuated by either the positive pressure or the negative pressure is provided. As a result, in the case where the fuel vapors are generated due to the rise of the temperature of the fuel and then the internal pressure in the fuel tank 7 is increased, the fuel tank can be prevented from expanding by letting the fuel vapors escape into the canister 14. In the case where the position of the lubrication port of the fuel tank 7 is higher than the mounting position of the canister 14, when the fuel is fully filled up to the filler opening, the fuel flows into the canister 14 due to the difference in the level between the fuel surfaces. The relief valve 71 is designed in such a way as to be closed when the internal pressure PT in the fuel tank is lower than a level of 20 to 40 mmHg, whereby since the internal pressure PT in the lubrication of the fuel is approximately equal to the atmospheric pressure, the relief valve 71 is closed so that the fuel never flow into the canister 14. In addition, the relief valve 71 is designed in such a way as to be opened when the internal pressure PT in the fuel tank is reduced to a level equal to or lower than −5 to −10 mmHg, whereby the internal pressure PT is maintained within a predetermined pressure range so as for the fuel tank 7 not to be deformed by the pressure difference due to the volume contraction and the like in the fuel consumption and the reduction of the temperature. Therefore, within the set values for opening the valve by the positive pressure and the negative pressure in the normal operation state, e.g., the range of −5 to 20 mmHg, as shown in an example of absence of the vapor leak of FIGS. 9(*a*)–9(*c*), the supply passage from the fuel tank 7 to the canister 14 can be considered as the closed system. It is, of course, to be understood that the present invention is not limited to those numerical values.

On the other hand, taking the generation of the fuel vapors and the internal pressure PT in the fuel tank 7 after the lapse of a predetermined period of time t from start of the engine into consideration, the internal pressure in the fuel tank 7 of the closed system in the operation of the engine can be expressed by the following expression.

$$PT = Po \cdot V / \{V - (Qevp - Qfuel)\} \quad (1)$$

where

Po is the current internal pressure in the fuel tank,

V is the space volume,

Qevp is the generation quantity of fuel vapors, and

Qfuel is the fuel consumption.

Further, the generation quantity Qevp of fuel vapors is gradually increased as the temperature in the fuel rises. However, within a relative short period of time, e.g., 5 minutes, it may be considered that Qevp is not changed. But, the condition of the operation of the engine under a high temperature, the high volatility fuel and the like are exceptional.

Thus, in the case of the operation of the engine within the short period of time, the internal pressure in the fuel tank 7 is changed in accordance with the fuel consumption Qfuel (lt./hr).

Figure 9A:
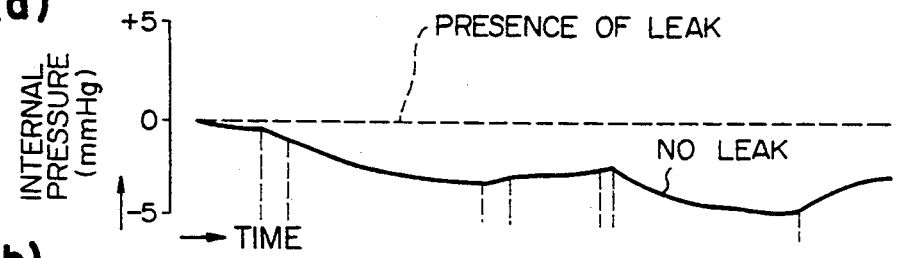
FIGS. 9(*a*)–9(*c*) are diagrams showing the change in the internal pressure in the fuel tank during the running of the vehicle.
Figure 9B:
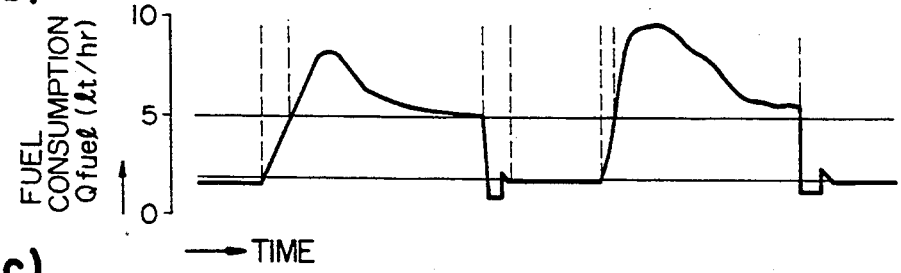
Figure 9C:
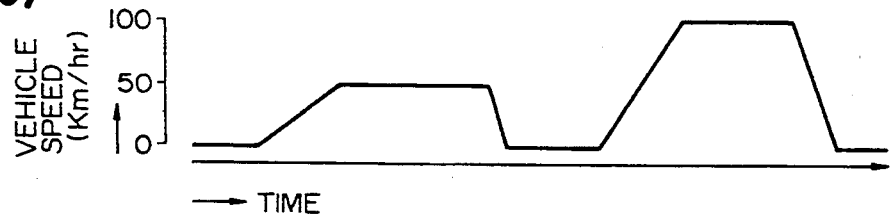

In addition, since in occurrence of the abnormality such as the vapor leak, the supply passage between the fuel tank 7 and the canister 14 does not form the closed system, even if the fuel consumption Qfuel is changed, the internal pressure in the fuel tank 7 will not be changed (refer to an example of presence of the vapor leak shown in FIGS. 9(*a*)–9(*c*)).

Now, in general, the fuel consumption Qfuel (lt./hr) can be calculated on the basis of the following expression.

$$\text{The fuel consumption } Qfuel \text{ (lt./hr)} = \text{the engine speed (rpm)} \times 60 \times \text{the number of cylinders} \div \alpha \times \text{the injector injection time (ms)} \times \text{the injector size (cc/min)} \div 60 \times 10^{-6} \quad (2)$$

where $\alpha = 1$ is established when the method is carried out in which the injection is simultaneously performed at every rotation, and $\alpha = 2$ is established when other injection methods are available.

The fuel consumption Qfuel (lt./hr) is calculated in such a way that the engine speed signal is input in the control circuit 16, and the calculation is performed on the basis of the engine ignition timing signal which has been produced in the control circuit 16, the number of cylinders which is previously recorded, and the injector size.

Next, the description will hereinbelow be given with respect to the flow chart of the processing of detecting the abnormality according to the present embodiment with reference to FIG. 8.

First, in Step S51, it is judged whether or not the judgement with respect to the normality has already been completed. Then, when the judgement with respect to the normality has already been completed, the processing gets out of this routine. On the other hand, when in Step S51, the judgement with respect to the normality has not already been completed, in Step S52, the internal pressure in the fuel tank 7 is detected. Then, the processing proceeds to Step S53. In Step S53, it is judged whether or not the internal pressure in the fuel tank 7 is within a predetermined pressure range. By the way, in the present embodiment, the relief pressure is previously set to a level, which is equal to or lower than −7 mmHg but equal to or higher than 25 mmHg, in the relief valve 71. Then, in Step S53, it is judged whether or not the internal pressure PT in the fuel tank is within the range of the relief pressure set in the relief valve 71, i.e., in the range of −5 to 20 mmHg. When the internal pressure PT is equal to or lower than −5 mmHg as the negative pressure in the relief valve, or equal to or higher than 20 mmHg as the positive pressure therein, it can be judged that as in the case where after stop of the engine 1, the engine is promptly restarted, the negative pressure or the positive pressure, which does not reach the relief pressure set in the relief valve 71, remains in the fuel tank 7. Therefore, in this case, the supply passage from the canister 14 to the fuel tank 7 can be regarded as the closed system, i.e., in the state in which no vapor leak is present therein. Then, in Step S63, the judgement of the normality is performed, and than the processing gets out of this routine.

In Step S53, if the internal pressure PT is within the relief pressure set in the relief value 71, i.e., in the range of −5 to 20 mmHg, the processing proceeds to Step S54. In Step S54, the calculation of the expression (2) is performed to obtain the fuel consumption Qfuel (lt./hr). Then, in Step S55, it is judged whether or not the fuel consumption Qfuel thus calculated is equal to or lower than the predetermined value. If in Step S55, the fuel consumption Qfuel is judged to be equal to or lower than the predetermined value, and then in Step S56, it is judged that the operation state under this condition has continued for a predetermined period of time (10 seconds), the processing proceeds to Step S57. Then, in Step S57, the data relating to the quantity ΔPTANK of change in the internal pressure in the fuel tank for that period of time (10 seconds) is stored in a memory ΔPLO for storing the data relating to the down value of the quantity of change in the internal pressure in the fuel tank. Further, when it is judged in Step S55 that the fuel consumption Qfuel is not equal to or lower than a predetermined value as a threshold, e.g., 1 (lt./hr), the processing proceeds to Step S58. In Step S58, it is judged whether or not the fuel consumption Qfuel is equal to or higher than a predetermined value of 5 (lt./hr) as a threshold. If the fuel consumption Qfuel is equal to or higher than the predetermined value of 5 (lt./hr), in the same manner as in the previous case where the fuel consumption Qfuel is little, in Step S59 and Step S60, the data relating to the quantity ΔPTANK of change in the internal pressure in the fuel tank for 10 seconds is stored in a memory ΔPHI for storing the data relating to the up value of the quantity of change in the internal pressure in the fuel tank.

More specifically, in the case where the fuel consumption Qfuel is equal to or lower than 1 (lt./hr), the increasing of the fuel vapor volume in the fuel tank 7 overcomes the increasing of the volume (reduction in the internal pressure) in the space part of the fuel tank 7 due to the supply of the fuel to the injectors 4. As a result, the internal pressure the fuel tank 7 shows the upward tendency rather than becoming negative pressure. Conversely, in the case where the fuel consumption Qfuel is equal to or higher than 5 (lt./hr), the increase in the volume (reduction in the internal pressure) in the fuel tank 7 due to the supply of the fuel to the injectors 4 overcomes the increasing of the fuel vapors generated in the fuel tank. As a result, the internal pressure of the fuel tank 7 shows the downward tendency rather than becoming positive pressure.

There is generally difference in the tendency of the internal pressure in the tank 7 between in a low fuel consumption (Qfuel≦1 lt./hr) and in a high fuel consumption (Qfuel≧5 lt./hr). As a result, when the fuel consumption Qfuel is little, i.e., equal to lower than 1 (lt./hr), the internal pressure in the fuel tank 7 shows the ascending tendency, and when the fuel consumption Qfuel is much, i.e., equal to or higher than 5 (lt./hr), the internal pressure in the fuel tank 7 shows the descending tendency, whereby ΔPTANK is obtained as the quantity of change in the internal pressure in the fuel tank before and after the lapse of the predetermined period of time, and the up rate in the ascending tendency and the down rate in the descending tendency can be stored in the memories ΔPLO and ΔPHI, respectively.

If it is judged in Step S61 that the up value of the quantity of change in the internal pressure in the fuel tank and the down value thereof have been respectively stored in the memories ΔPLO and ΔPHI, and both the up rate and the down rate of the quantity ΔPTANK of change in the internal pressure in the fuel tank have been measured, the processing proceeds to Step S62. Then, on the basis of the ratio of the data in the memory ΔPLO storing the up rate of the quantity ΔPTANK of change in the internal pressure in the fuel tank and the data in the memory ΔPHI storing the down value thereof, it is judged whether the fuel evaporative emission control system operates normally or abnormally. That is, in the case where the absolute value of the data in the memory ΔPLO storing the up rate of the quantity ΔPTANK of change in the internal pressure in the fuel tank is compared with the absolute value of the data in the memory ΔPHI storing the down rate thereof, as shown in the expression (1), the internal pressure in the fuel tank depends on the space volume V of the fuel tank. Therefore, the difference judgement values are necessarily required depending on the quantity of fuel in the fuel tank. Then, in the present embodiment, on the basis of the ratio of the down rate and the up rate, the desired judgement is performed. The fact that the relationship of ΔPLO/ΔPHI=1 is established means that even if the fuel consumption is changed, the internal pressure in the fuel tank will not be changed. As a result, it can be detected that the leak failure is occurring. Of course, in this case, it is not meant that ΔPLO/ΔPHI is precisely equal to "1". That is, by taking the error ranges of the calculation and the sensors into consideration, the range of 1±0.1 to 1±0.2 may also be available for the ratio of ΔPLO/ΔPHI.

Further, if in Step S62, the relationship of ΔPLO/ΔPHI≠1 is established, the processing proceeds to Step S63. In Step S63, it is judged that the fuel evaporative emission control system operates normally, and then the processing gets out of this routine. Alternatively, if in Step S62, the relationship of ΔPLO/ΔPHI=1 is established, the processing proceeds to Step S64. Then, in Step S64, it is judged that the fuel evaporative emission control system operates abnormally. However, for the purpose of reducing the probability of the erroneous detection, as in Step S65, only when the judgement of the abnormality is continuously performed over 5 times or more, the processing can proceed to Step S66. Then, in Step S66, the alarm (NG) lamp 17 is turned an and off as the display for the abnormal operation.

In the second embodiment shown in the form of the block diagram of FIG. 6, the fuel consumption detecting unit M11 executes the processing of calculating the fuel consumption in Step S54 of FIG. 8. The comparison unit M12 executes the routine from Step S55 to Step S62 in the flow chart of FIG. 8. The judgement unit M13 executes the routine from Step S62 to Step S65 in the flow chart of FIG. 8. Moreover, the alarm unit M9 executes Step S66. The functions of those units are executed by the microcomputer contained in the control circuit 16 in accordance with the program to which the flow chart of FIG. 8 is written.

In the present embodiment as well, the same effects as those of the first embodiment can be obtained.

Now, in the present embodiment, the fuel consumption detecting unit M11 is operates to execute the processing in Step S54 of obtaining the quantity of consumed fuel supplied from the fuel tank M2(7) to the internal combustion engine M1. The present invention does not limit the fuel consumption detecting unit M11 to measurement of the actual fuel consumption, but allows to indirectly obtain the fuel consumption by calculation, for example by operating the expression (2). The fuel consumption value obtained from the expression (2) does not accurately represent the actual fuel consumption, but corresponds to the actual fuel consumption value and is sufficient for achieving the purpose of the invention. As can be seen from the change in the internal pressure in the fuel tank of FIG. 9(*a*), the change in the fuel consumption Qfuel of FIG. 9(*b*) and the change in the vehicle speed of FIG. 9(*c*), the change in the fuel consumption Qfuel and the change in the vehicle speed correspond approximately to each other. In addition, the vehicle speed corresponds to the engine speed and also corresponds approximately to the intake air flow. Therefore, in the flow chart of FIG. 8, instead of the fuel consumption Qfuel, the vehicle speed, the engine speed or the air flow rate may be used.

Moreover, a method may also be adopted such that the condition is added in which the period of time from the storage of the down rate in the memory ΔPLO to the storage of the up rate in the memory ΔPHI is within a predetermined period of time in order to prevent the erroneous detection due to the change in the quantity of the fuel vapors generated in the fuel tank.

Further, the judgement unit M13 of the present embodiment actuates, in order to improve the reliability of the judgement, the alarm unit M4 by repeating the judgement of the abnormality by 5 times in the routine from Step S64 to Step S65. However, when embodying the present invention, to judge in Step S65 whether or not the judgement of the abnormality has been continuously performed by 5 times or more may be omitted.

What is claimed is:

1. A self-diagnosis apparatus for use in a fuel evaporative emission control system for a vehicle having an internal combustion engine, comprising:

a vapor passage which couples part of a fuel tank and an intake air passage to each other and through which fuel vapors from said fuel tank pass;

a canister which is provided in said vapor passage and operates to absorb the fuel vapors from said fuel tank;

pressure detecting means for detecting an internal pressure in said part of said fuel tank;

means for calculating quantity of change in the internal pressure detected by said pressure detecting means during a lapse of a certain period of time; and judgement means for comparing the internal pressure change quantity with a predetermined reference value to perform the judgement of abnormality in accordance with comparison result, wherein said means for calculating the internal pressure change quantity includes means for detecting a maximum value and a minimum value of the internal pressure in said fuel tank during the lapse of a predetermined period of time, and said judgement means includes means for judging whether or not a difference between the maximum value and the minimum value is larger than a predetermined reference value by the comparison, and alarm means for generating a judgement output representing the abnormality at the time when the difference is not larger than the predetermined reference value, said apparatus further comprising counter means for counting the elapsed period of time just after start of said engine, and means for measuring a travel distance of said vehicle from just after start of said engine, wherein said alarm means generates, in the case where the difference is not larger than the predetermined reference value, when at least one of a condition that a count value of said counter means reaches a value relating to the lapse of a predetermined period of time and a condition that the travel distance reaches a predetermined distance is fulfilled, the judgement output representing the abnormality.

2. A self-diagnosis apparatus according to claim 1, wherein said means for detecting the maximum value and the minimum value of the internal pressures in said fuel tank includes:

means for judging whether or not the internal pressure in said fuel tank, which is detected at the time of start of said internal combustion engine by said pressure detecting means, is in a predetermined range; and means for generating, at the time when it is judged that said internal pressure is in the predetermined range, a temporary abnormality judgement output.

3. A self-diagnosis apparatus according to claim 2, further comprising:

memory means for storing, at a time when it is judged that said internal pressure is in the predetermined range, the maximum value and the minimum value of the internal pressure;

means for comparing, at the time when the temporary abnormality judgement output is being generated, a current internal pressure in said fuel tank, and the maximum value and the minimum value stored in said memory means with each other; and means for updating, at the time when the current internal pressure is equal to or higher than the maximum value, the maximum value stored in said memory means to the current internal pressure value, and updating, at the time when the current internal pressure is equal to or lower than the minimum value, the minimum value stores in said memory means to the current internal pressure value, wherein said judgement means uses both the maximum value and the minimum value which are stored in said memory means.

4. A self-diagnosis apparatus according to claim 3, wherein said alarm means includes an alarm unit which operates to generate at least one of an audible sound and visible rays as an alarm.

5. A self-diagnosis apparatus according to claim 3, wherein said pressure detecting means includes at least one pressure sensor.

6. A self-diagnosis apparatus according to claim 3, wherein with said fuel evaporative emission control system, a control valve which operates to open and close in accordance with a control signal is provided in the passage which couples said canister of said vapor passage with said intake air passage of said internal combustion engine.

7. A self-diagnosis apparatus according to claim 3, further comprising:

means for calculating the quantity of change in the internal pressure in said fuel tank; and a microcomputer which operates to execute the processings of said judgement means.

8. A self-diagnosis apparatus for use in a fuel evaporative emission control system for a vehicle having an internal combustion engine, comprising:

a vapor passage which couples part of a fuel tank and an intake air passage to each other and through which fuel vapors from said fuel tank pass;

a canister which is provided in said vapor passage and operates to absorb the fuel vapors from said fuel tank;

pressure detecting means for detecting an internal pressure in said part of said fuel tank;

means for calculating quantity of change in the internal pressure detected by said pressure detecting means during a lapse of a certain period of time; and judgement means for comparing the internal pressure change quantity with a predetermined reference value to perform the judgement of abnormality in accordance with the comparison result, said apparatus further comprising means for detecting the fuel consumption of said internal combustion engine, wherein said means for calculating the quantity of change in the internal pressure includes means for calculating, at the time when the detected fuel consumption is equal to or lower than a first predetermined value, an increasing rate of the internal pressure and calculating, at the time when the detected fuel consumption is equal to or higher than a second predetermined value, a decreasing rate of the internal pressure, and said judgement means includes means for calculating a ratio of the increasing rate and the decreasing rate, means for comparing the ratio and a predetermined reference value with each other, and alarm means for generating, at the time when the ratio is not substantially equal to the predetermined reference value, a judgement output representing the abnormality.

9. A self-diagnosis apparatus according to claim 8, wherein the value of the ratio is substantially in the range of 0.9 to 1.2.

10. A self-diagnosis apparatus according to claim 9, wherein said alarm means generates the judgement output representing the abnormality at the time when a case where the ratio is not substantially equal to the predetermined reference value is continuously present by plural times.

11. A self-diagnosis apparatus according to claim 10, wherein said fuel evaporative emission control system includes, in the passage which couples said canister of said vapor passage and said space part of said fuel tank to each other, a pressure value which operates to close the passage at the time when a pressure in the passage is in a predetermined pressure range and open the passage at the time when the pressure in the passage is beyond the predetermined pressure range.

12. A self-diagnosis apparatus according to claim 11, wherein said means for calculating the quantity of change in the internal pressure in said fuel tank calculates both the increasing rate and the decreasing rate of the internal pressure at the time when the internal pressure is in the predetermined pressure range.

13. A self-diagnosis apparatus according to claim 11, further comprising:

means for calculating the quantity of change in the internal pressure in said fuel tank; and a microcomputer which operates to execute the processings of said judgement means.

14. A self-diagnosis apparatus according to claim 13, wherein said alarm means includes an alarm unit which operates to generate at least one of an audible sound and visible rays as an alarm.

15. A self-diagnosis apparatus according to claim 13, wherein said pressure detecting means includes at least one pressure sensor.

16. A method of performing self diagnosis for a fuel evaporative emission control system, for an internal combustion engine, including a vapor passage which couples a part of a fuel tank and an intake air passage to each other and through which fuel vapors from said fuel tank pass, a canister which is provided in said vapor passage and operates to absorb the fuel vapors from said fuel tank, and pressure detecting means for detecting an internal pressure in said space part of said fuel tank, said method comprising the steps of:

calculating the quantity of change in the internal pressure, which has been detected by said pressure detecting means, during a lapse of a certain period of time;

comparing the internal pressure change quantity and a predetermined reference value with each other to perform the judgement of abnormality in accordance with the comparison results; and detecting the fuel consumption of said internal combustion engine, wherein said step of calculating the quantity of change in the internal pressure is to calculate, when the detected fuel consumption is equal to or less than a first predetermined value, an increasing rate of the internal pressure and calculate, when the detected fuel consumption is equal to or more than a second predetermined value, a decreasing rate of the internal pressure, and said step of judging the abnormality is to calculate a ratio of the increasing rate and the decreasing rate, compare the ratio and a predetermined reference value with each other, and generate, when the ratio is not substantially equal to the predetermined reference value, a judgement output representing the abnormality.

17. A self-diagnosis apparatus for use in a fuel evaporative emission control system for a vehicle having an internal combustion engine, comprising:

a vapor passage which couples a part of a fuel tank and an intake air passage to each other and through which fuel vapors from said fuel tank pass;

a canister which is provided in said vapor passage and operates to absorb the fuel vapors from said fuel tank;

pressure detecting means for detecting an internal pressure in said part of said fuel tank;

means for calculating quantity of change in the internal pressure detected by said pressure detecting means during a lapse of a certain period of time, said calculating means including means for detecting a maximum value and a minimum value of the internal pressure of said fuel tank during the lapse of a predetermined time period; and judgement means for comparing the internal pressure change quantity with a predetermined reference value to perform the judgement of abnormality in accordance with the comparison result, said judgement means including means for judging whether or not a difference between the maximum value and the minimum value is larger than a predetermined reference value by the comparison counter means for counting the elapsed time period just after start of said engine, and means for generating a judgement output representing the abnormality in a case where the difference is not larger than the predetermined reference value and a certain condition is fulfilled, said certain condition including that said counter means reaches a predetermined time which is sufficient to arise variation in the internal pressure of the fuel tank as fuel is consumed upon engine operation.

18. An apparatus according to claim 17, further comprising means for determining whether or not said internal pressure detected at the time of start of said engine is in a predetermined range, and alarm means for generating an alarm when said determining means determines that said internal pressure is in the predetermined range, and said judgement means outputs said judgement output representing the abnormality.

19. A method of permitting a self-diagnosis for a fuel evaporative emission control system, for an internal combustion engine, utilizing a self-diagnosis apparatus, the apparatus including a vapor passage which couples a part of a fuel tank and an intake air passage to each other and through which fuel vapors from said fuel tank pass, a canister which is provided in said vapor passage and operates to absorb the fuel vapors from said fuel tank, the pressure detecting means for detecting an internal pressure in said part of said fuel tank;

means for calculating quantity of change in the internal pressure detected by said pressure detecting means during a lapse of a certain period of time, said calculating means including means for detecting a maximum value and a minimum values of the internal pressure of said fuel tank during the phase of a predetermined time period; and judgement means for comparing the internal pressure change quantity with a predetermined reference value to perform the judgement of abnormality in accordance with the comparison result, said judgement means including means for judging whether or not a difference between the maximum value and the minimum value is larger than a predetermined reference value by the comparison counter means for counting the elapsed time period just after start of said engine; and means for generating a judgement output representing the abnormality in a case where the difference is not larger than the predetermined reference value and a certain condition is fulfilled, said certain condition including that said counter means reaches a predetermined time which is sufficient to arise variation in the internal pressure of the fuel tank as fuel is consumed on engine operation.

* * * * *